US005676427A

United States Patent [19]

Ha

[11] Patent Number: 5,676,427

[45] Date of Patent: Oct. 14, 1997

[54] APPARATUS FOR HYDRAULICALLY SPLITTING UP ROCK

[76] Inventor: Jong Su Ha, Dae Ha Bldg. 307 14-11, Yoeyido-Dong Youngdeung Po-Ku, Seoul, Rep. of Korea

[21] Appl. No.: 525,438

[22] Filed: Sep. 7, 1995

[30] Foreign Application Priority Data

Sep. 7, 1994 [KR] Rep. of Korea ..... 94-23035

[51] Int. Cl.[6] ..... E21C 37/02

[52] U.S. Cl. ..... 299/21; 166/177.5

[58] Field of Search ..... 299/22, 23, 20; 166/177.5

[56] References Cited

U.S. PATENT DOCUMENTS

| | | | |
|---|---|---|---|
| 3,576,348 | 4/1971 | Zielinski | 299/23 |
| 3,690,460 | 9/1972 | Lebedev . | |
| 3,894,772 | 7/1975 | Darda | 299/22 |
| 4,071,095 | 1/1978 | Herron et al. | 299/23 X |
| 4,072,353 | 2/1978 | Clark et al. | 299/22 |
| 4,168,862 | 9/1979 | Langfield | 299/23 |
| 4,215,901 | 8/1980 | Langfield et al. | 299/22 |
| 4,474,410 | 10/1984 | Ogaki et al. | 299/23 |
| 4,571,002 | 2/1986 | Akanuma et al. | 299/22 |
| 4,871,212 | 10/1989 | Lebedev . | |
| 5,000,517 | 3/1991 | Lebedev . | |
| 5,015,039 | 5/1991 | Anderson | 299/22 |

*Primary Examiner*—Frank Tsay
*Attorney, Agent, or Firm*—Keck, Mahin & Cate

[57] ABSTRACT

An apparatus for hydraulically splitting up rock includes a hydraulically operated piston-cylinder assembly as an oil delivering and controlling part. A split pair of thrust members accommodates an elastic rubber tube, a pair of expanding inserts and a pair of holding bushings. This apparatus may be applied in construction, tunnel mining, quarry mining, demolition of reinforced concrete foundations and so on.

2 Claims, 9 Drawing Sheets

FIG. 6 (A)(1)
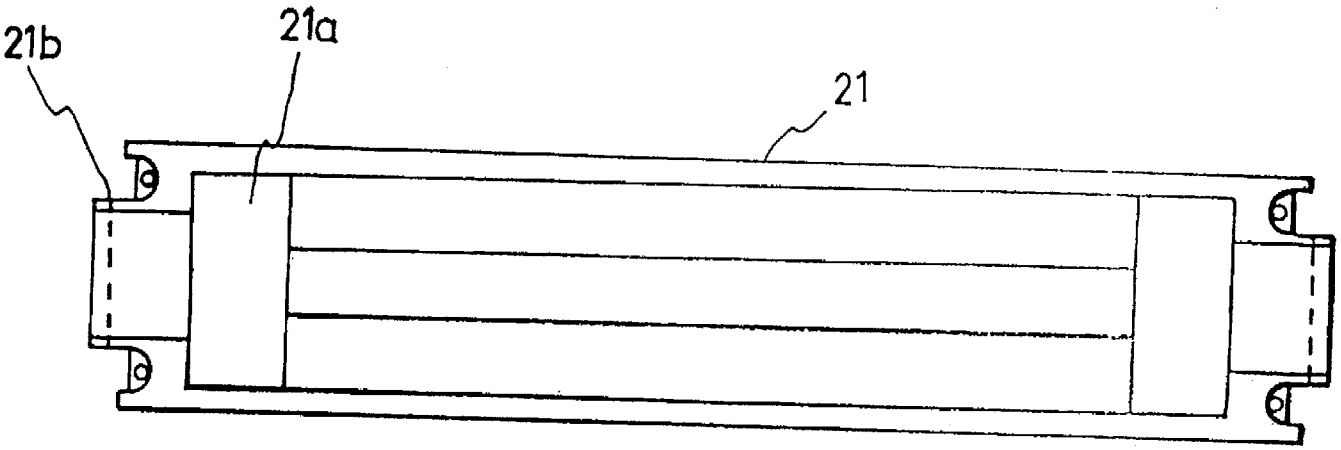
FIG. 6 (A)(2)
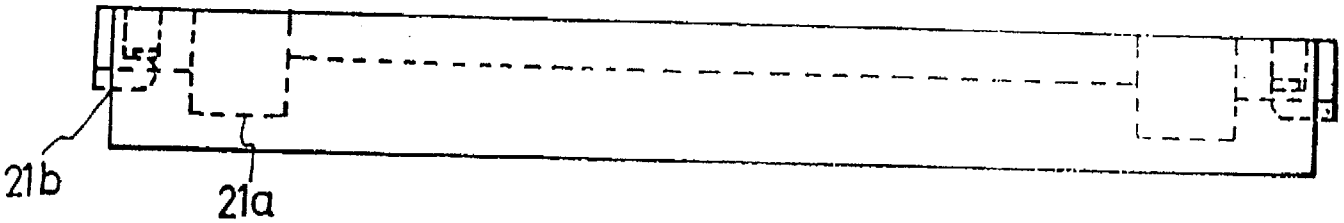

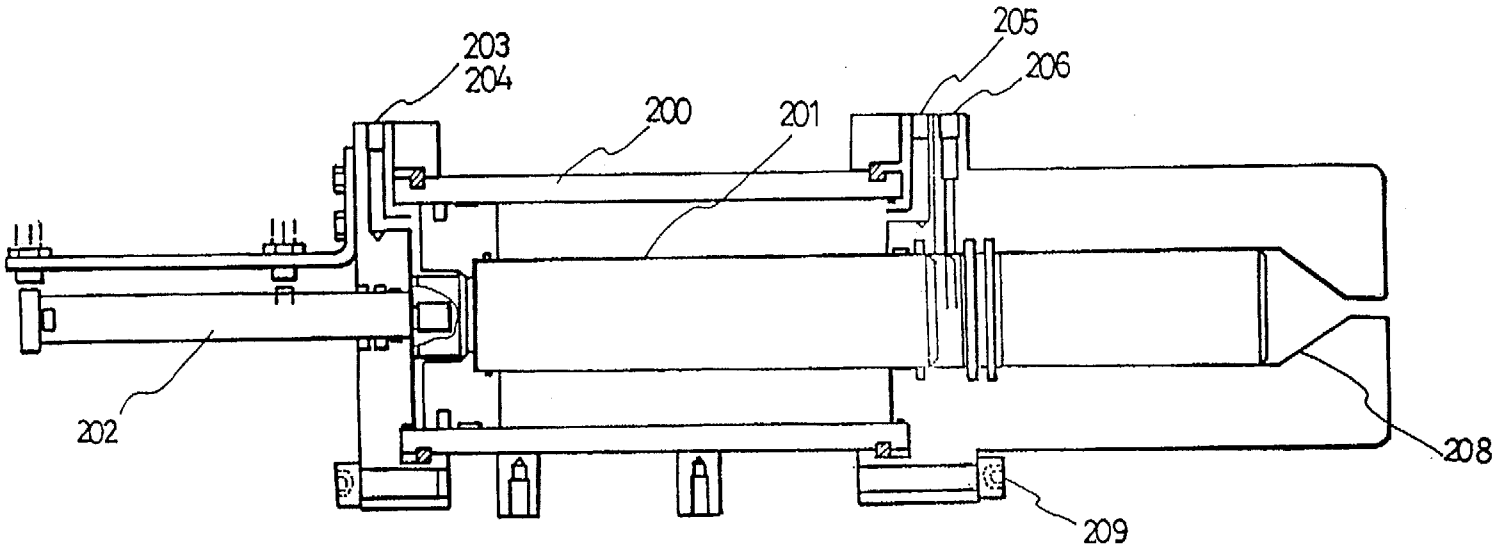
FIG. 9(A)(1)
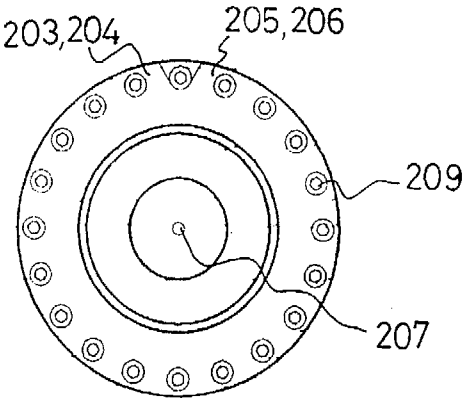
FIG. 9(A)(2)

APPARATUS FOR HYDRAULICALLY SPLITTING UP ROCK

BACKGROUND OF THE INVENTION

1. Field of the Invention

The present invention relates to rock splitters. More particularly, the present invention relates to hydraulically actuated rock splitter which may be used for splitting rock or reinforced concrete along the directed line. So this invention is believed to be found in the General Class entitled, "Mining or in Situ-Disintegration of hard Material" (Class 229) and in the subclass entitled, "expansible breaking down devices—piston" (subclass 22) and the subclass using "Wedges" (subclass 23).

2. Description of the Related Arts

Known in the prior arts are a Power Unit shown in U.S. Pat. No. 4,690,460, Device for Building up Directional Force as shown in U.S. Pat. No. 4,871,212. A powered member for splitting Rock and other Bodies is shown in U.S. Pat. No. 5,000,517.

The Power Unit comprises a housing internally accommodating along the longitudinal axis and throughout the entire length thereof a tubular elastic vessel, two inserts, two pipe unions with conical shaped ends thereof, two holders with two flanges, two elastic elements surrounding the elastic vessel, two bushings rigidly interrelated with the shape of conical pipe union et al.

The Powered Member comprises an axially parting casing accommodating a coaxially mounted flexible tubular chamber, spacer inserts, a pair of nipples with cone shaped head thereof moving along the longitudinal axis of the casing, a pair of cylindrical bushings interconnected by means of a tenon and mortise joint, et al.

However, the devices known in the prior arts failed to be applied in the industrial and constructional fields. The reasons for the failure of the prior arts are as follows. All numbers are from FIG. 3. The first defect of them is the failure of sealing. In the stationary situations the ends of rubber tube (flexible tubular vessel 2) are rigidly clamped between the head of nipples 6 and the inner face of the bushing 9 and 10, and the working medium is free from leaking out from the devices. But in the dynamic situation the working medium comes out, for example, when the working medium is delivered under ultra high pressure, about, 10 MPa. The working oil leaks out along the generatrix of the conical surface of the head of the nipple 11 and 12, because that the inner surface of the flexible tubular vessel is to be pressed by the working oil outwardly, and there should be formed clearance between the inner surface of the rubber tube and the outer surface of the nipple head 11 and 12.

The second defect of the devices is the jamming of the rubber tube between the face 5 of the bushings and the perpendicular face of the grooved recess of the housing. So long as there is any micro clearance between the faces, in the dynamic moment, the surface of the rubber tube flows out into this clearance by the high pressure of the working liquid. This flowing out of the rubber tube into the clearance results in not only bursting of the tube 2, but also in jamming of the small pieces of rubber between the metal parts (bushing and housing), and leads to stopping of movement of them. The inventor of the prior arts paid his special attention to these-like phenomena, and employed "elastic conical rings 22 as shown in FIG. 2," "Cone-shaped rings made with teflon 1 and 2 as shown in FIG. 1," and "Washer surrounding the rubber tube and accommodated in the conical recess in the front face of the bushing."

According to both patents the inventors disclosed that "the cylindrical bushings be interconnected by means of radially extending fasteners 14. . . . the bushing can axially move upon pressure supply . . . ", "said nipples 4 being mounted on sides of end face of the casing for movement along the longitudinal axis thereof . . . " "two pipe unions 4 which is configurated and mounted for longitudinal movement". But all these devices cannot prevent the "flowing of rubber tube into the microclearance between the end faces of the bushings and the walls of the annular groover of the casing".

The third defect is easy breaking at the most weak point along the generatrix of the annular groove of the casing 5. This breaking out of the casing is fatal to the reliability of the devices. The pressure of the working medium directs not only to the axial faces, but also to the longitudinal direction, more exactly to the head face of the nipple 11. This force pushes the bushing block against the walls of the annular grooves of the casing and leads to breaking out thereof.

The forth defect is that there is no provision to limit the overexpanding of the rubber tube 2 and the devices as a whole at the moment when the hard object(rock) is splitted or broken by the expanding force of the device.

Up to the moment of splitting of the object, the pressure and resistance curve is in direct proportion to the volume of working medium or to the pressing time. But at the moment of completely splitting of the object, the Resistance curve shifts abruptly to the height of the weight of the object, and the pressure curve drops down slowly, so there should be some difference between the both curves. This difference leads to overexpanding of the rubber tube and the devices as a whole over the mechanical and structural limit of them. And finally the insert 3 shall come out from the housing and the rubber tube shall be burst out.

When manual hand pump is used for delivery of the working medium into the device, the pumping speed shall be very slow and the operator can react at the splitting moment, but if any kinds of electric motor pumps are used, the device without any additional automatic reactioning equipment, which not only limits additional flowing of working oil into the flexible tube, but also withdraws working oil from the tube at the splitting moment, can not prevent overexpanding of the rubber tube and the device as a whole at the said moment with the difference.

Therefore, all the above mentioned defects result from the unrealistic hypothesis, namely, the hydro-statics, based on which the related arts were made and constructed.

SUMMARY OF THE INVENTION

All the above mentioned problems shall be solved by a completely new designed apparatus composed of an expanding part with different structure among the component parts, and an oil delivering and controlling device, which are theoretically based on the hydro-dynamics. The expanding part comprises an axially split casing having an annular recess and wings at the both ends of it, a rubber tube with jagged and shaded part at the both ends of it, a pair of trapezoidal inserts, a pair of cylindrical bushings and its caps received in the casing and having an innerly jagged and shaded line and receiving a pair of elastic conical rings, and a pair of guiding and limiting rings. The controlling and oil delivering device is composed of a housing having four inlet ports and one outlet port and a bell shape at the front inside of it, and with a piston attached by a bar indicating its movement at the rear end of it.

This structure of the expanding apparatus makes it possible to dispense with a number of parts which are essential and indispensable in the prior arts, namely, with such kind of nipples being mounted on sides of end faces of the casing, for movement along the longitudinal axis of the casing, with a means for attaching each end of the flexible chamber to the head of the nipple being formed by a pair of cylindrical bushings, with such kind of bushing interconnected by means of a tenon and mortise joint, with washers, with radially extending fasteners, with pipe unions and holders and so on.

This structure of the controlling and oil delivering device makes it possible to let the air escape from the rubber tube, to get information about the changing the moment of the pressure and the volume in the rubber tube which makes us possible to react at the critical splitting moment and minimizes the longitudinal pressing force of the working medium against the front inner wall of the cylinder chamber.

It is to be understood that both the foregoing general description and the following detailed description are exemplary and explanatory and are intended to provide further explanation of the invention as claimed.

BRIEF DESCRIPTION OF THE DRAWINGS

FIGS. 6(A)(1) and 6(A)(2) show the casing with wings at the both ends thereof.

FIGS. 9(A)(1) and 9(A)(2) are a longitudinal sectional views of the oil delivering and controlling device.

DESCRIPTION OF PREFERRED EMBODIMENTS

Figure 1A:
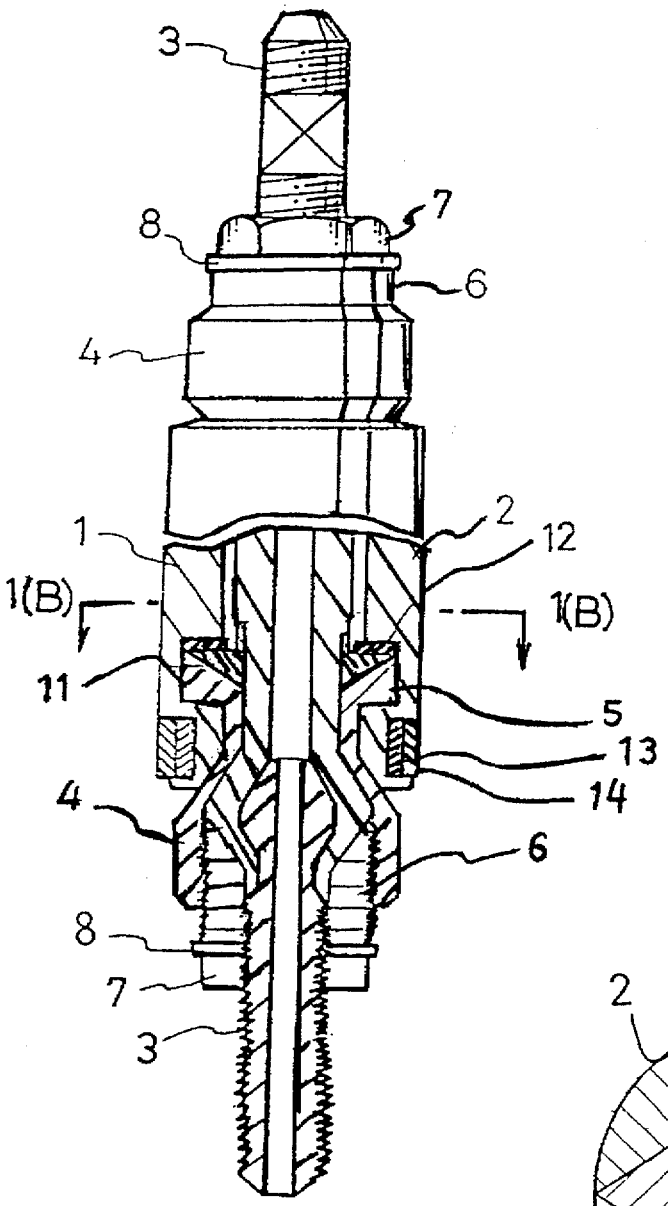
FIG. 1(A) PRIOR ART
FIG. 1(A) and 1(B) represent partially cut-away longitudinal and axial cut views of the prior art shown in U.S. Pat. No. 4,690,460 as shown in its FIGS. 1 and 2.
Figure 1B:
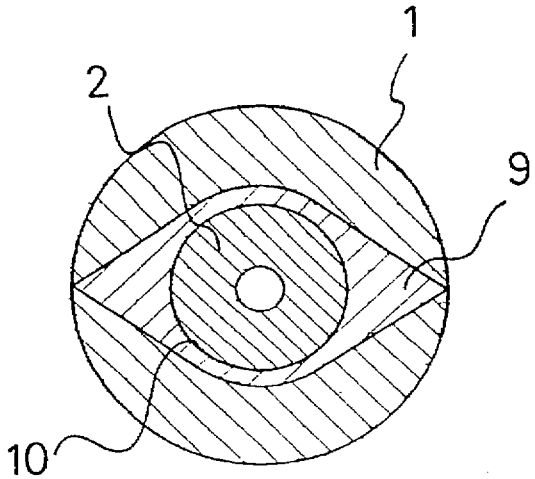
FIG. 1(B) PRIOR ART
Figure 2A:
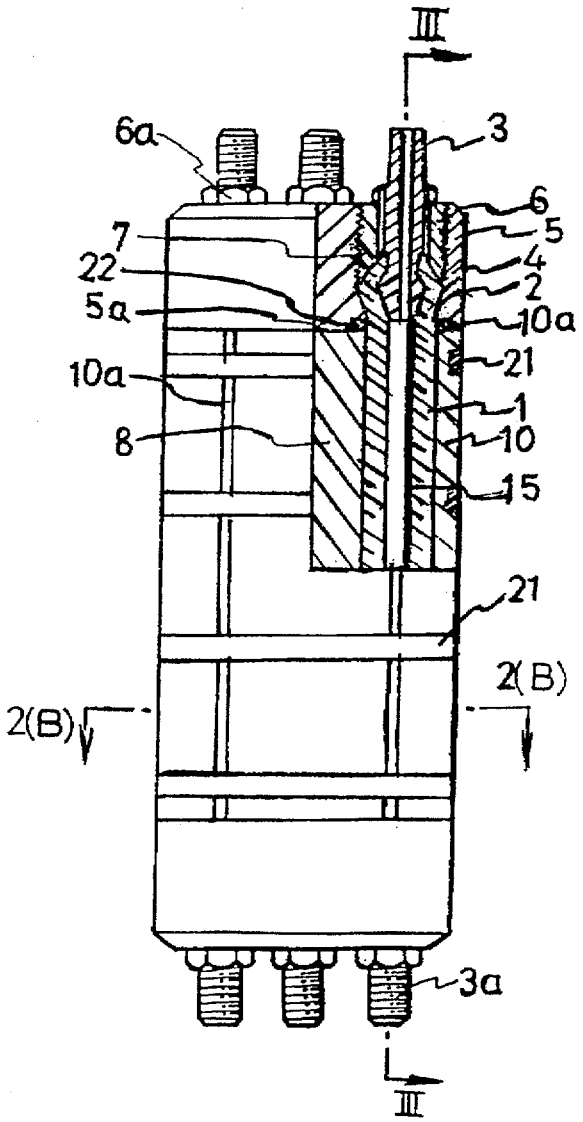
FIG. 2(A) PRIOR ART
FIG. 2(A) and 2(B) represent fragmentary longitudinal section and axial cut views of the prior art shown in U.S. Pat. No. 4,871,212 as shown in its FIGS. 1 and 2.
Figure 2B:
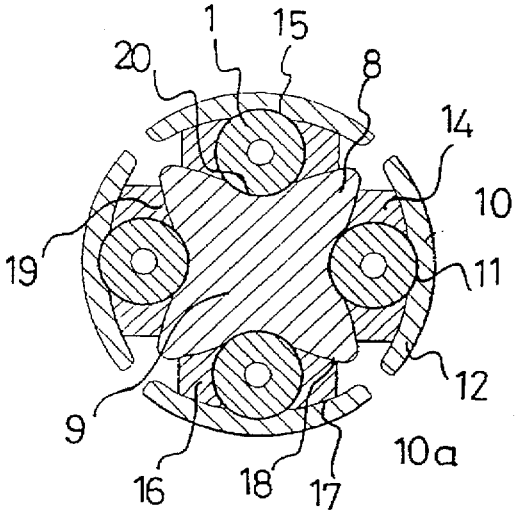
FIG. 2(B) PRIOR ART
Figure 3A:
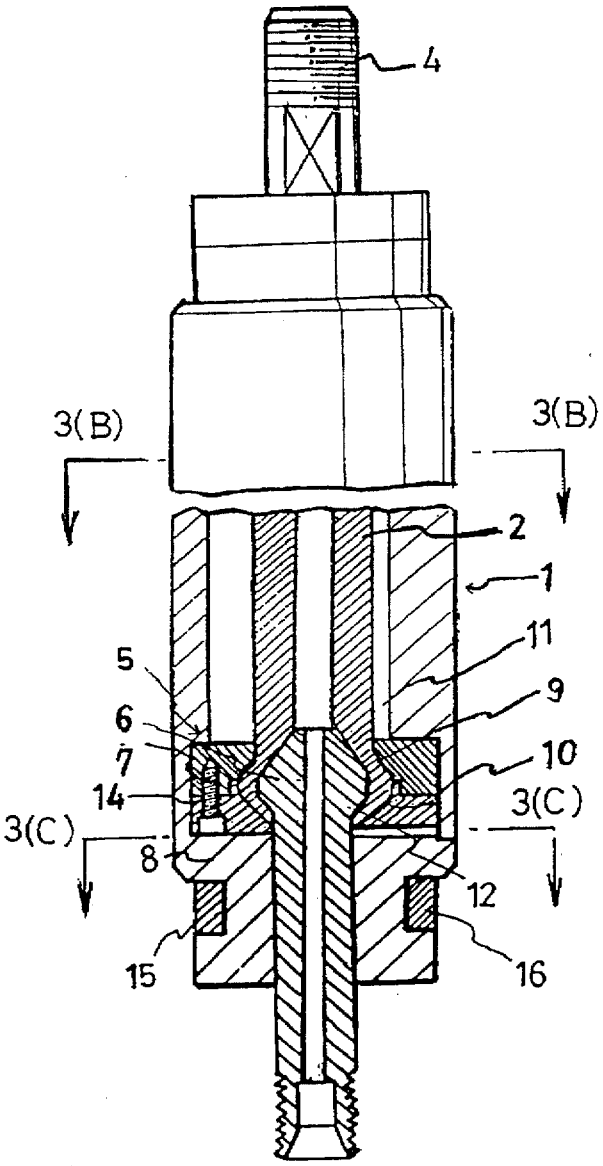
FIG. 3(A) PRIOR ART
FIGS. 3(A), 3(B), and 3(C) represent longitudinal and axial section view of the prior art shown in U.S. Pat. No. 5,000,517 as shown in its FIGS. 1, 2 and 3.
Figure 3B:
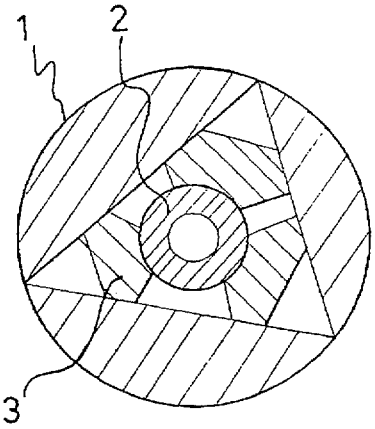
FIG. 3(B) PRIOR ART
Figure 3C:
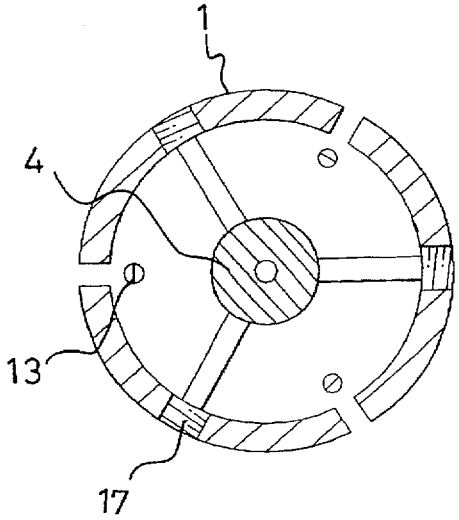
FIG. 3(C) PRIOR ART

Referring now in detail to the drawings showing the present invention, these are illustrated in FIGS. 4–9. Apparatus for Hydraulically Splitting up Rock according to the invention, which is designed for splitting the rock along the line of boreholes, comprises a housing 21 being longitudinally split and having two wings 21*b* and annular grooves 21*a* at each end of it (see FIGS. 6(A)(1) and 6(A)(2), accommodating a coaxially mounted rubber tube 22 having jagged 22*b* and shaded 22*a* surfaces at the both ends of it (see FIG. 6(B)), and a pair of inserts 23 (see FIG. 7) being located on the sliding side of the parting plane of the casing 21 and a pair of cylindrical bushings 24 with jagged 24*a* and shaded 24*b* inner surfaces and positioning in the annular grooves 21*a* of the casings 21, a pair of guiders 29 with two guiding faces and one ring 28 (see FIG. 8), a pair of conical rubber packings 26 accommodated in the bushings 24 and the cap 25 (see FIG. 5), a bolt 36 with a shaded surface at its summit (see FIG. 5), and a piston 201 (see FIG. 9(A)) with a bar 202 attached to its rear face (see FIG. 9(A)(1)), a housing 200 has one inleting port 203 and one pressure sensing port 204 at its rear part, two inleting ports 205 and 206 at its middle part, and one outleting port 207 at a front part of the housing. A bell shaped inner line 208 of the housing (see FIG. 9(A)(1)) has as it function reducing the longitudinal pressing force of the working medium and minimizing the tensioning burden of the jointing bolts 209.

Figure 4:
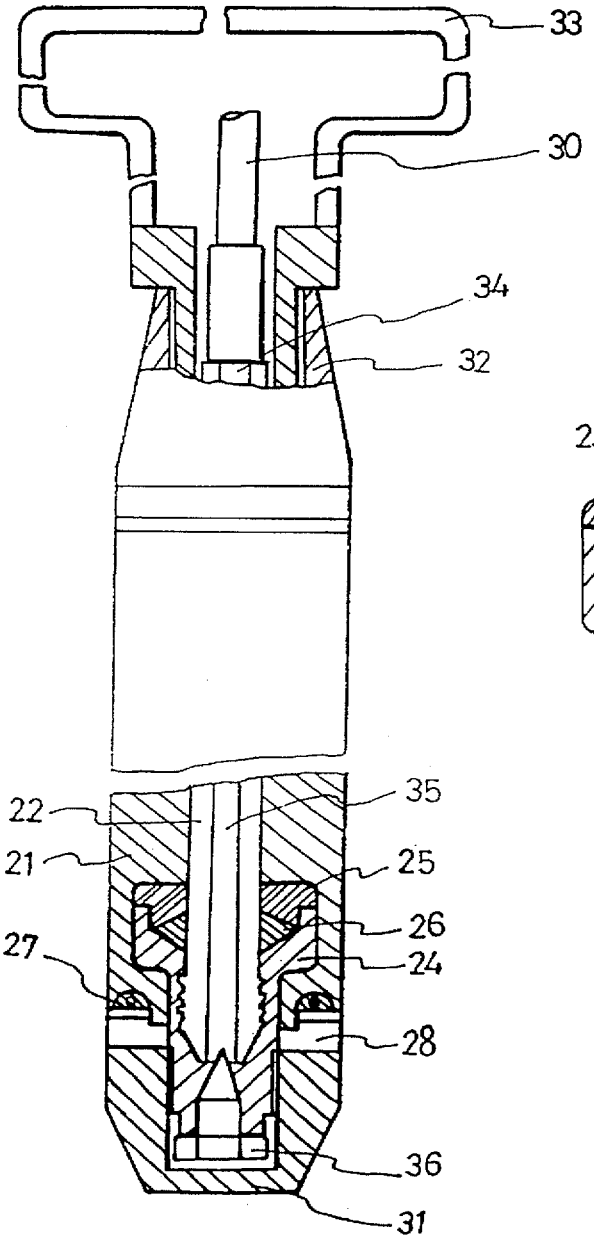
FIG. 4 represents assembled working part of the apparatus according to the present invention, partly in longitudinal section thereof.
Figure 5:
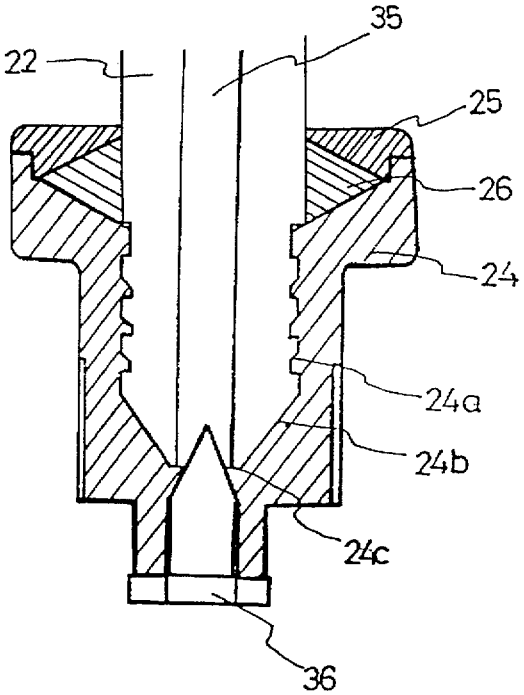
FIG. 5 represents the plane drawing of the bushing with the innerly jagged and shaded line and its cap accommodating the conical rubber packing and breaking bolt.
Figure 6B:
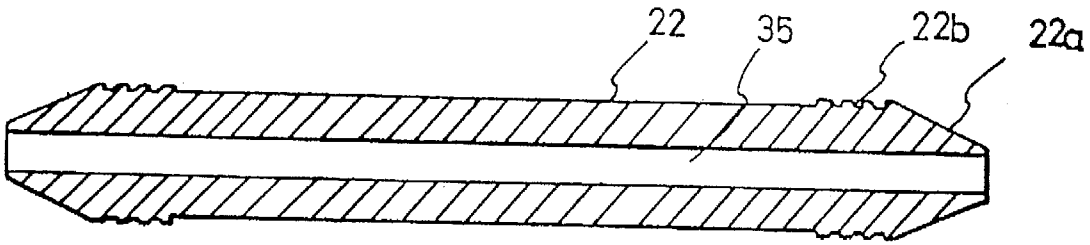
FIG. 6(B) shows the rubber tube having jagged and shaded surfaces at the both ends thereof.
Figure 6C:
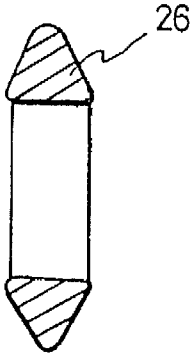
FIG. 6(C) shows the conical compensation rubber ring.
Figure 7:
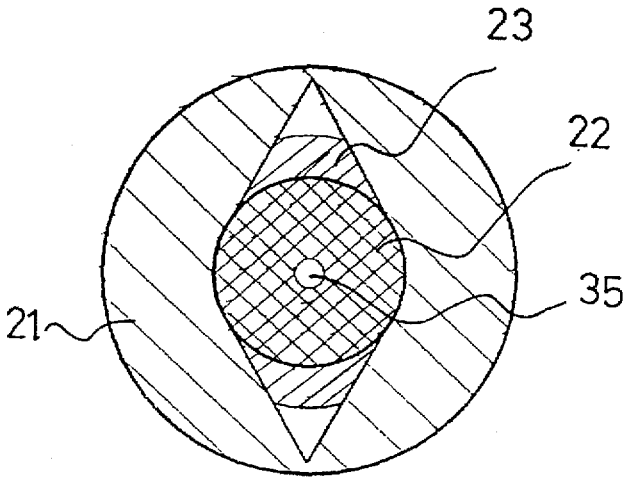
FIG. 7 shows the axial cut view of the Device.
Figure 8:
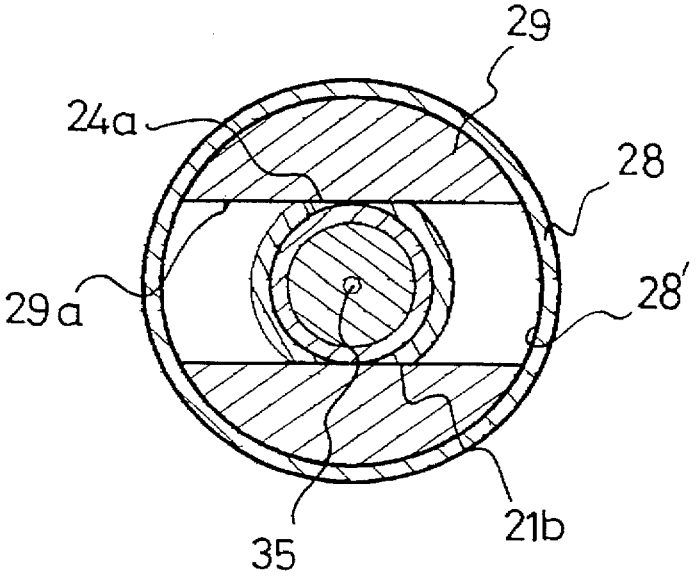
FIG. 8 shows the guiding face and coordinating ring which are interconnected together.

The apparatus functions in the following manner. In the embodiment as illustrated in FIG. 4, the working oil comes from the oil delivering device 200 through the inner passing channel of the bushing 30 into the rubber tube 35 and is blocked by the blocking bolt 36 at the opposite side. When this working oil presses the rubber tube 22 against the inner wall of the bushing 24, then the jagged and shaded surface of the rubber tube 22*a* and 22*b* shall be pushed into the correspondingly jagged and shaded inner surface of the bushing 24*a* and 24*b*. This dynamic reaction of the flexible rubber tube to the pressure of the working oil prevents perfectly leaking of oil out of the device. The shaded inner surface of the bushing 24*b*, the outer surface of the rubber tube 22*a* and the blocking bolt 36 disperse the longitudinal pressure to the axial direction, so the longitudinal force acting on the bushing block and on the outside wall of the casing 21*a* shall be minimized. The structure according to this principle prevents cracking along the generatrix of the annular grooves of the casing 21*a*', and substantially prolongs the life time of the casings 21. Under the pressure of the working oil in the interior space of the rubber tube, the rubber packing 26 shall be pressed at first and pushes the bushing 24 and bushing cap 25 to the longitudinal opposite direction.

By the pushing force of the rubber packing the bushing cap 25 compensates for the microclearances between the bushing block and the annular grooves 21*a* of the casing. This structure according to the dynamic principles prevents the rubber tube from flowing into the microclearance, and ensures the long life time of the rubber tube and the smooth movement of the casing during expanding and returning to the starting position.

At the next stage of expanding of the rubber tube, the pressure of the working oil in the rubber tube presses the inserts 23 axially outward and the inner face of the casing free from inserts.

In the field situation the resistance of the rock on the whole length of the surface of the casing cannot be constant and equal even in the same bored hole. From this fact the casings move unbalancedly. The single-sided expansion of the rubber tube accompanying with the uneven movement of the casings with respect to the initial axis of the device leads to overexpanding of the rubber tube at any point and at last to either bursting of the rubber tube or breaking of the casings.

The combined structure of the cutted face of the casings 21*b*, the guiding face 29*a*, and the coordinating ring 28 function interconnectedly to ensure the even and balanced expanding of the casings and results in balanced movement of the whole parts of the device in the dynamic situation. As shown in FIG. 9(C), up to the T2 and P2 point the curve of the pressure goes up together with that of the resistance, but at the T2 point the resistance curve shifts abruptly to the height of Rc which corresponds to the real weight of the split rock.

But the pressure curve(P) drops down slowly with time gap, so there should be some difference between the values of pressure and resistance(P-R). This difference leads to overexpanding over the constructional limit of the whole device and then to bursting out of the rubber tube, to coming out of the inserts from the casings.

Figure 9B:
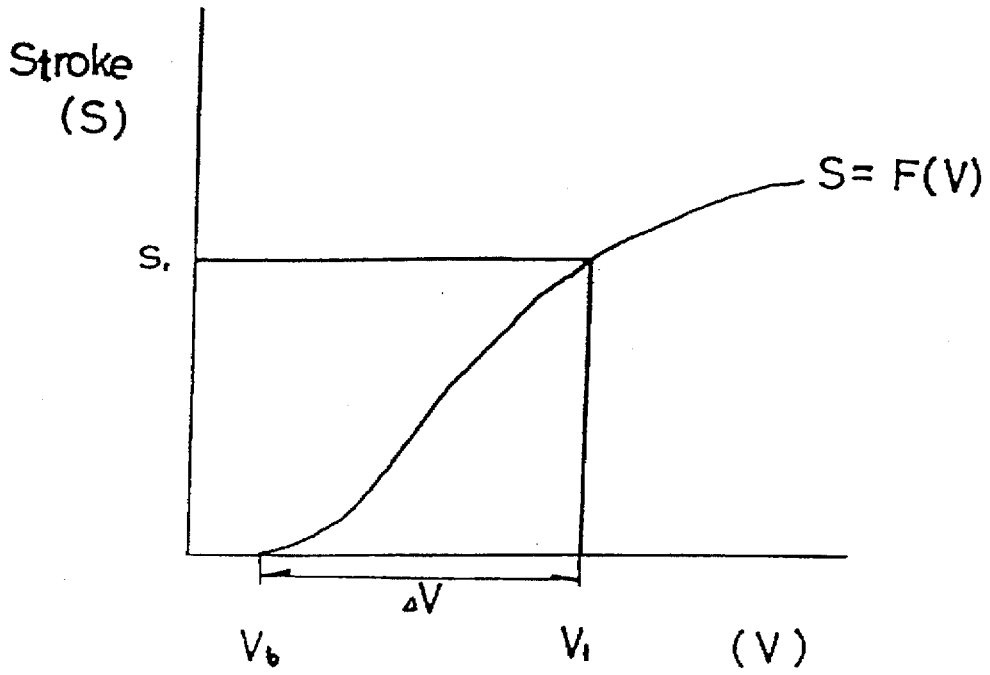
FIG. 9(B) is a graph showing the relationship between oil volume and stroke.
Figure 9C:
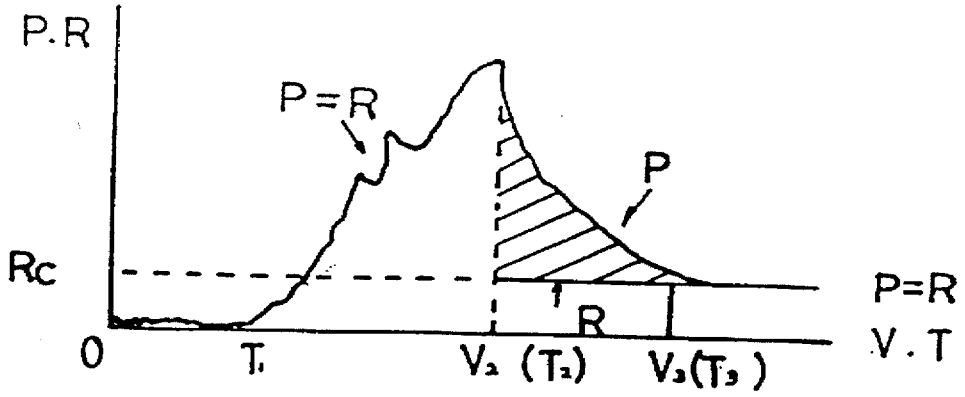
FIG. 9(C) shows the changing pressure and resistance curve according to the volume of working oil and pumping time.

The oil delivering and controlling device (see FIGS. 9(A)(1)and 9(A)(2) according to the invention informs us with the splitting moment—resistance curve's shifting moment—and affords us to withdraw delta volume of the pumped oil from the rubber tube to the delivering device in a microsecond. The bell shaped inner face 208 of the cylinder 200 also reduces the pressing force towards longitudinal direction, so the tensioning burden of the jointing bolts 209 of the device shall be minimized. The expanding part (see FIG. 4) and the oil delivering device (see FIG. 9(C)) are closely interrelated together and are composed as integral parts of this Apparatus for Hydraulically Splitting up Rock.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for hydraulically splitting up rock comprising:

a longitudinally split casing, wings at opposite ends of said split casing, each portion of said split casing having two annular grooves, a rubber tube having a jagged surface and an inclined surface at both ends thereof, a pair of inserts having trapezoidal cross-sections and located along a parting plane splitting said casing, a pair of bushings, each of said bushings having a jagged inner surface and an inclined inner surface accommodating one end of said rubber tube, a cap disposed at one end of each of said bushings, a pair of guiders having two guiding faces and one ring, and a bolt with an inclined surface at its summit closing off another end of each of said bushings.

2. An apparatus according to claim 1, and further comprising:

a piston, a bar attached to a rear end of said piston, and a housing having one inlet port and one pressure sensing port at a rear part thereof, two inlet ports at a middle part thereof, and one outlet port at a front part thereof, and defining a bell shaped housing interior.

* * * * *